US005456097A

United States Patent [19]

Zakhary et al.

[11] Patent Number: 5,456,097

[45] Date of Patent: Oct. 10, 1995

[54] LUBRICATION SYSTEM FOR CONTAINER FABRICATING IRONER

[75] Inventors: Nashat Z. Zakhary, Hasbrouck Heights, N.J.; Armen Zakarian, Arlington Heights, Ill.

[73] Assignee: Crown Cork & Seal Company, Inc., Philadelphia, Pa.

[21] Appl. No.: 332,652

[22] Filed: Nov. 1, 1994

Related U.S. Application Data

[63] Continuation of Ser. No. 259,115, Jun. 10, 1994, abandoned, which is a continuation of Ser. No. 65,573, May 21, 1993, abandoned.

[51] Int. Cl.[6] ..... B21D 37/18

[52] U.S. Cl. ..... 72/44; 72/349; 210/805

[58] Field of Search ..... 210/171, 805; 72/44, 45, 342.3, 347, 349; 137/412; 184/6.24, 103.2

[56] References Cited

U.S. PATENT DOCUMENTS

| | | | |
|---|---|---|---|
| 2,140,289 | 10/1936 | Hurtt et al. . | |
| 2,401,340 | 6/1946 | Dunmire et al. | 72/44 |
| 2,629,826 | 2/1953 | McIlvaine et al. | 137/412 |
| 2,999,597 | 9/1961 | Harms . | |
| 3,618,707 | 11/1971 | Sluhan . | |
| 4,171,034 | 10/1979 | Gallant | 184/6.24 |
| 4,535,615 | 8/1985 | Ebben . | |
| 4,771,804 | 9/1988 | Morales | 137/412 |
| 5,020,350 | 6/1991 | Knepp et al. . | |
| 5,090,225 | 2/1992 | Schimion . | |
| 5,244,586 | 9/1993 | Hawkins et al. | 210/805 |
| 5,262,071 | 11/1993 | Tuck . | |

FOREIGN PATENT DOCUMENTS

90/02560 11/1990 WIPO .

*Primary Examiner*—Lowell A. Larson
*Attorney, Agent, or Firm*—Frank J. Nawalanic

[57] ABSTRACT

A lubrication system for an body maker of the type which is used in a container fabrication facility to shape a metallic can body includes a filter, a first conduit for conveying coolant from the body maker to an inlet side of the filter, a second conduit for conveying coolant from an outlet side of the filter to the body maker, a pump in one of the conduits for pumping coolant in a circuit which includes the filter, the conduits and the body maker, and a coolant makeup system for adding coolant to the circuit. The coolant makeup system is constructed and arranged to continuously supply coolant to the circuit to make up for continuous losses of coolant at the body maker.

7 Claims, 2 Drawing Sheets

LUBRICATION SYSTEM FOR CONTAINER FABRICATING IRONER

This is a continuation of application Ser. No. 08/259,115, filed Jun. 10, 1994, now abandoned, which is a continuation of application Ser. No. 08/065,573, filed May 21, 1993, now abandoned.

BACKGROUND OF THE INVENTION

1. Field of the Invention

This invention relates generally to systems which are used to fabricate metallic container bodies of the type which are used for holding beverages or the like. More specifically, this invention relates to an improved lubrication system for a body maker or "ironer" in such a fabrication system which provides an increase in metallic container manufacturing cleanliness and efficiency, paticularly in cans.

2. Description of the Prior Art

In a facility for fabricating metallic can bodies, specialized presses known as body makers are used to draw cup-shaped metallic can blanks into the elongated, thin aluminum or steel can bodies with which consumers are familiar. One such type of body maker is termed an "ironer." During this process, an enormous amount of heat and friction is generated, requiring a substantial amount of coolant to be supplied to the body makers. Besides cooling the body makers, such coolant flushes away metal particles or "fines" from the tooling within the body makers, as well as lubricating the body makers. Referring now to FIG. 1, which depicts a typical conventional lubrication system 10, a plurality of ironers 12 are provided with coolant through a supply manifold 14, which is passed into a return manifold 16 after use. The coolant or is cleansed through a filtration arrangement which includes a filter 18, a supply conduit 20 leading from an outlet side 28 of the filter to the supply manifold 14, and a return conduit 22 leading from the return manifold 16 to an inlet side 26 of the filter 18. Pumps 30 are provided in the supply conduit 20 and the return conduit 22 to induce a continuous flow of coolant through the filtration circuit.

In such a conventional system, the filtration circuit would be operated for a period of time until it would be noticed or anticipated that the level of coolant had dropped to a level which required replacement. At that time, premixed coolant would be introduced into the return conduit 22 from a make up tank 24 by a conduit 32 in which a pump 34 was interposed. A manual valve 36 would be provided in the conduit 32 for preventing coolant from being introduced into the return conduit 22 except when such introduction was desired.

Although conventional coolant systems such as that depicted in FIG. 1 have been effectively used in the metal container fabricating industry, it is to be recognized that improvements in such aspects as cleanliness, efficiency, filter media life, and the amount of coolant or cleansing water used would be considered desirable by the industry.

SUMMARY OF THE INVENTION

Accordingly, it is an object of this invention to provide an improved cooling system for body makers in a metal container fabrication facility which results in the fabrication of cleaner can bodies than was heretofore possible.

It is further an object of the invention to provide an improved cooling system for such a facility which requires less lubricating oil and other ingredients per ironer than was heretofore considered necessary.

It is further an object of the invention to provide an improved cooling system for such a facility which reduces the amount of chemicals that are necessary to clean the can bodies after fabrication.

In order to achieve the above and other objects of the invention, a system for supplying a cooling mixture to an body maker in a container fabricating facility includes a filter; a first conduit for-conveying coolant from an body maker to inlet side of the filter; a second conduit for conveying coolant from an outlet side of the filter to the body maker; a pumping system for pumping coolant in a circuit including the filter and the conduits; and a coolant make up system for adding coolant to the circuit, the coolant make up system being connected to the second conduit between the outlet side and the body maker, whereby make up coolant is not forced unnecessarily through the filter.

According to a second aspect of the invention, a system for supplying a coolant mixture to a body maker in a container fabricating facility includes a filter; a first conduit for conveying coolant from an body maker to an inlet side of the filter; a second conduit for conveying coolant from an outlet side of the filter to the body maker; a pumping system for pumping coolant in a circuit including the filter and the conduits; and a coolant make up system for adding coolant to the circuit, the coolant make up system being constructed and arranged to continuously supply coolant to the circuit to make up for a continuous loss of coolant at the body maker.

According to a third aspect of the invention, a lubrication system for a container fabricating facility includes an body maker for shaping a metallic can body; a filter; a first conduit for conveying coolant from the body maker to an inlet side of the filter; a second conduit for conveying lubricating from an outlet side of the filter to the body maker; a pumping system for pumping coolant in a circuit including the filter, the conduits and the body maker; and a lubrication make up system for adding coolant to the circuit, the coolant make upsystem being connected to the second conduit between the outlet side of the filter and the body maker, whereby make up coolant is not forced unnecessarily through the filter.

According to a fourth aspect of the invention, a lubrication system for a container fabricating facility includes a body maker for shaping a metallic can body; a filter; a first conduit for conveying coolant from the body maker to an inlet side of the filter; a second conduit for conveying coolant from an outlet side of the filter to the body maker; a pumping system for pumping coolant in a circuit including the filter, the conduits and the body maker; and a coolant make up system for adding coolant to the circuit, the coolant make up system being constructed and arranged to continuously supply coolant to the circuit to make up for a continuous loss of coolant at the body maker.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
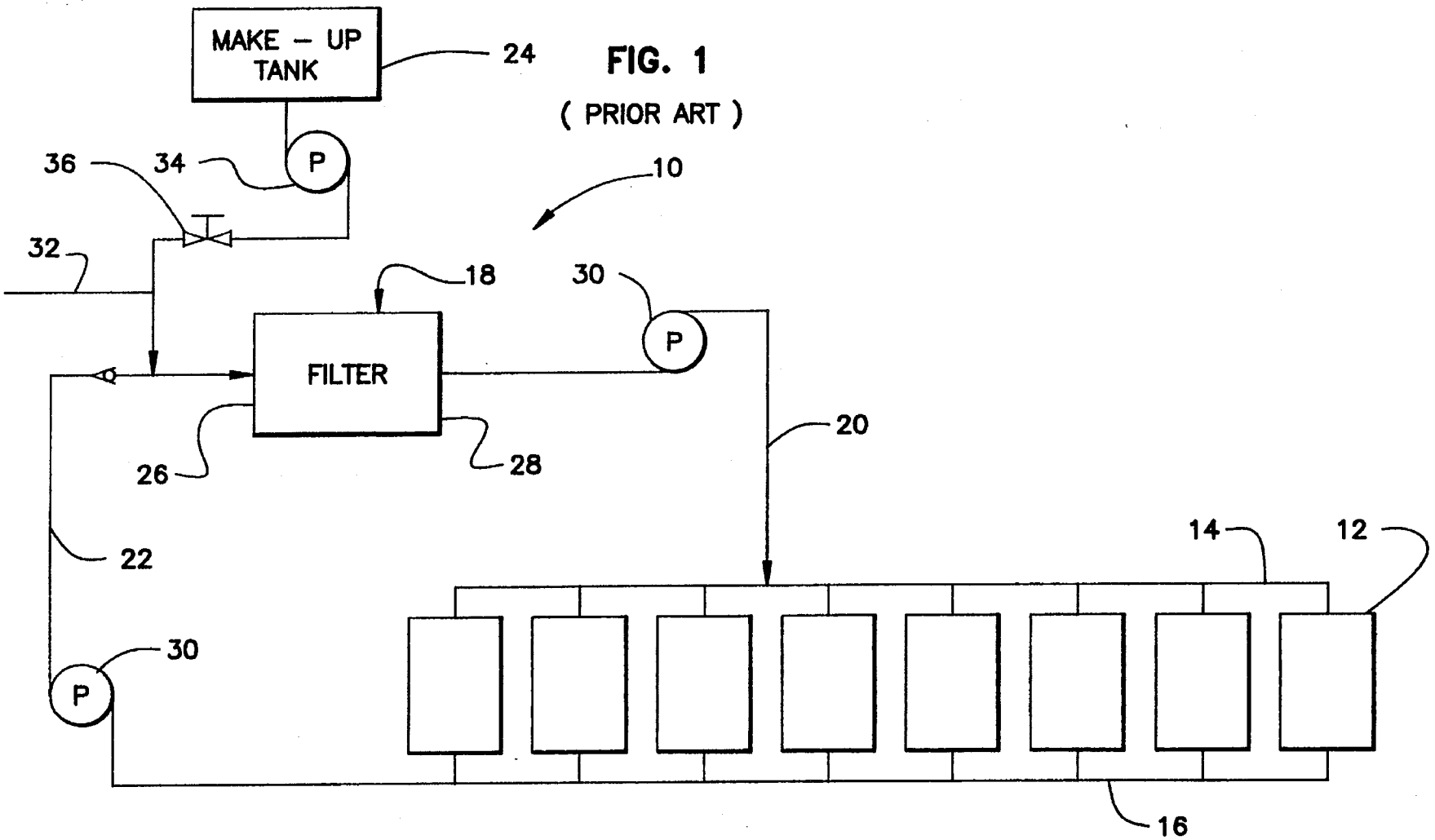
FIG. 1 ( PRIOR ART )
FIG. 1 is a schematic representation of a conventional system for cooling body makers in a metallic can fabrication facility.
Figure 2:
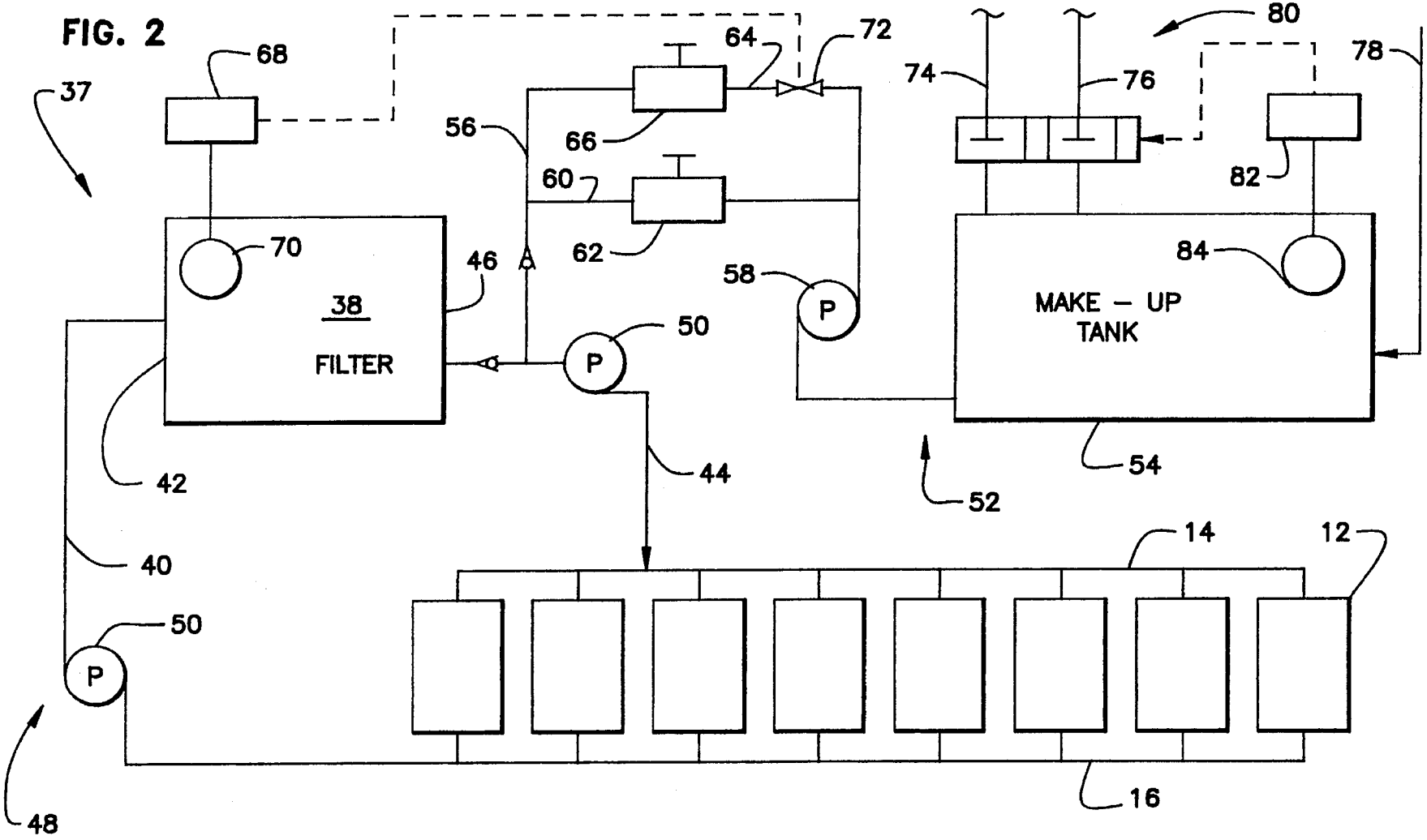
FIG. 2 is a schematic representation of an improved system for cooling body makers in a metallic can fabrication facility.

Referring now to the drawings, wherein like reference numerals designate corresponding structure throughout the views, and referring in particular to Figure 2, an improved system 37 for supplying a coolant mixture to a number of body makers 12 in a metallic container fabrication facility also includes a supply manifold 14 and a return manifold 16. Improved system 37 includes a filtration circuit 48 which includes a filter 38, a first conduit 40 for conveying coolant from the return manifold 16 to an inlet side 42 of filter 38, and a second conduit 44 for conveying coolant from an outlet side 46 of filter 38 to the supply manifold 14. A pumping system including pumps 50 is provided to pump coolant in a circuit including the first conduit 40, the second conduit 44, the body makers 12 and filter 38. One pump 50 is interposed in the second conduit 44, as may be seen in FIG. 2.

Filter 38 is preferably the type that is commercially available from Womack International Inc. of Novato, Calif. as Model No. HP-20.

According to one important aspect of the invention, a continuous coolant make up system 52 is provided for continuously introducing coolant into the second conduit 44 at a point between the outlet side 46 of filter 38 and the supply manifold 14 for the body maker 12. Continuous coolant make up system 52 draws premixed coolant from a make up tank 54 through a third conduit 56 by means of a pump 58 which is interposed in third conduit 56, as may be seen in FIG. 2. An outlet end of third conduit 56 is shown connected to second conduit 44 at a point between the outlet side 46 of filter 8 and the pump 50 for the filtration circuit 48, although it is to be understood that the outlet of third conduit 56 could be connected at any point between the outlet side 46 and the body maker 12. By introducing the coolant to the filtration circuit 48 at a point immediately prior to the body makers 12 rather than to the inlet side 42 of the filter 38, the inventors have achieved a dramatic improvement in terms of maintaining a stable and constant concentration of coolant, a constant pH level, a low level of bacteria and fungi in the coolant, a very low aluminum content of the coolant, a marked improvement in the appearance of the coolant in terms of its cleanliness, a longer life for the filter media, a reduction in the amount of chemicals which are necessary to clean the can bodies after fabrication, a reduction in the amount of solid sludge and waste water treatment, and a savings of 30% to 40% in terms of coolant oil. The inventors believe that the prior process of adding the make up oil at the inlet side 42 of the filter allowed some ingredients such as polymers and surfactants to react and combine with metallic elements and dirt which had collected on the inlet or dirty side of the filter. This in turn formed metal soaps, which increased the corrosive effect of the coolant on the tooling in the body makers 12.

In the preferred embodiment of the invention, the third conduit 56 which is used to convey coolant from make up tank 54 to the second conduit 44 includes a first branch 60 having an adjustable flow limiting orifice 62 interposed therein, and a second branch 64 having a controllable shut-off valve 72 and a second adjustable flow limiting orifice 66 both interposed therein in series relationship. Preferably, each of the adjustable flow limiting orifices 62, 66 include a meter for determining the actual flowrate therethrough. A level sensor 68 having a float 70 is provided somewhere within the filtration circuit 48, preferably in a chamber within the filter 38, as may be seen in FIG. 2. Flow orifice 62 in first branch 60 is constructed and arranged to limit fluid flow therethrough to a first flow rate, and flow orifice 66 in second branch 64 limits fluid flow therethrough to a second flow rate. During normal operation of the system, when the level of coolant therein is not beneath a predetermined minimum, pump 58 will continuously introduce coolant into the second conduit 44 from make up tank 54 through third conduit 56 through the first branch 60 and flow orifice 62. If level sensor 68 in filter 38 determines that fluid level in filtration circuit 48 has fallen beneath the predetermined minimum, shut off valve 72 will be opened by level sensor 68, enabling pump 58 to pump coolant through both branches 60, 64 of the third conduit 56. This will allow coolant to be introduced into the second conduit 44 at a rate sufficient to bring the level of coolant in the filtration circuit 48 back to the predetermined minimum level. At that point, level sensor 68 will close shut off valve 72, and normal operation will resume. In a recent facility which was constructed, the first flow orifice 62 was constructed to allow coolant to pass therethrough at a rate of approximately 1 gallon per minute, and flow orifice 66 was constructed to allow coolant to pass through therethrough at a rate of approximately 5 gallons per minute.

According to another aspect of the invention, make up tank 54 may be provided with an automatic proportionate fill control system which is connected to a source 74 of oil and a source 76 of water. A source 78 of biocide is separately connected to make up tank 54. It is to be understood that the preferred coolant is a combination of oil, water and biocide, and that the fill control system could be modified to be adaptable for other combinations of liquids that may be considered desirable as a coolant. In this system, a level sensor 82 has a float 84 position within make up tank 54. When the sensed level is beneath a predetermined minimum, level sensor 82 actuates a proportioner 80, which introduces oil from source 74 and water from source 76 into make up tank 54 at predetermined proportions. Proportioner 80 is commercially available from Crown Technology Corporation in Lake Forest, Ill., and is disclosed in U.S. Pat. No. 4,279,229, the disclosure of which is hereby incorporated herein. When desired, biocide may be automatically or manually added to make-up tank 54 from the source 78 of biocide.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A system for supplying a mixture including oil and water as a lubricant and coolant to a body maker in a container fabricating facility, comprising:

a filter having an inlet and an outlet;

a first conduit in fluid communication with said body maker and said inlet side of said filter;

first pumping means for pumping said first mixture, as a spent mixture, from said body maker to said inlet side of said filter;

a second conduit in fluid communication with said outlet side of said filter and said body maker;

second pumping means for pumping said first mixture, as a cleansed mixture from said outlet of said filter to said body maker;

a tank;

means for supplying a second mixture including make up oil and water at a set proportion to said tank whereby said second mixture is maintained as a constant homogenous mixture at said set proportion within said tank; and third pumping means for continuously supplying said second mixture at a set rate through a third conduit to said second conduit containing said filtered mixture.

2. A system according to claim 1, wherein said pumping means includes said third conduit in fluid communication with said second conduit and said tank, said third conduit having a first branch which is constructed and arranged to let said second mixture pass therethrough at said set rate, and a second branch which is constructed and arranged to let said second mixture pass therethrough at a second higher rate, said second branch having control means interposed therein for permitting said second mixture to flow through said second branch and combine with said second mixture flowing through said first branch into said second conduit only when the amount of said mixture in said filter falls beneath a predetermined minimum, and said tank having float control means for filling said tank with a batch of said second mixture and refiling said tank when the level of said second mixture in said tank drops below a set level with a batch of make up oil and water at a set proportion.

3. A system according to claim 2, wherein said control means comprises a level sensor positioned within said filter for sensing the level of said mixture in said filter, and an automatic valve in said second branch which is responsive to said level sensor.

4. The system of claim 3 wherein said second mixture further includes a biocide, said second pumping means including a pump in said second conduit, said third conduit in fluid communication with said second conduit on the inlet side of said second pump.

5. A method for supplying a mixture including at least oil and water as a coolant and lubricant to a metal body maker in a container fabrication facility comprising the steps of:

a. providing said body maker with an inlet and an outlet;

b. supplying a first mixture of at least oil and water to said body maker inlet and removing said first mixture from said body maker outlet;

c. providing a filter with an inlet and an outlet for cleansing said first mixture downstream of said body maker;

d. moving said first mixture from said body maker outlet to said filter inlet and from said filter outlet to said body maker inlet;

e. providing a mixing, float controlled tank;

f. supplying a second mixture of make up oil and water to said tank in a set proportion maintained as a homogenous mixture in said tank;

g. continuously introducing said second mixture at a first rate into said first mixture between said filter outlet and said body maker inlet; and h. periodically refilling said premix tank when its fluid content drops below a set level with a subsequent mixture of make up oil and water which may vary in set proportion from that of said second mixture and continuously introducing said subsequent mixture as a constant homogeneous mixture at said first rate into said first mixture until the fluid level in said mixing tank requires an additional quantity of make up oil and water.

6. The method of claim 5 further including the steps of:

h. sensing the quantity of said first mixture in said filter;

i. increasing the continuous rate of said second mixture to a second higher rate when the quantity of said mixture decreases below a set limit; and j. reverting back to said first flow rate in step (g) when said quantity of said first mixture reaches a second set limit.

7. The method of claim 6 wherein said second mixture includes a biocide in set proportion to said oil and water.

* * * * *